US005899387A

United States Patent [19]

Haruch

[11] Patent Number: 5,899,387

[45] Date of Patent: May 4, 1999

[54] AIR ASSISTED SPRAY SYSTEM

[75] Inventor: James Haruch, Naperville, Ill.

[73] Assignee: Spraying Systems Co.

[21] Appl. No.: 08/934,348

[22] Filed: Sep. 19, 1997

[51] Int. Cl.[6] ..... B05B 1/28

[52] U.S. Cl. ..... 239/296; 239/419; 239/424; 239/427.3; 239/431; 239/545

[58] Field of Search ..... 239/290, 296, 239/419, 424, 424.5, 429, 430, 427, 427.3, 431, 433, 543, 544, 545

[56] References Cited

U.S. PATENT DOCUMENTS 1,587,249 6/1926 Starr ..... 239/427

5,165,605 11/1992 Morita et al. ..... 239/296

*Primary Examiner*—Andres Kashnikow
*Assistant Examiner*—Dinh Q Nguyen
*Attorney, Agent, or Firm*—Leydig, Voit & Mayer, LTD

[57] ABSTRACT

An improved air-assisted spray nozzle assembly includes a section for receiving liquid and gas streams and a spray tip located downstream therefrom. The spray tip has a downstream chamber for receiving the liquid and gas with passages, each terminating with a cavity. The cavity cooperates with complementary notched portions for directing discharging flow streams in a predetermined direction for defining a well defined conical or flat spray pattern.

19 Claims, 3 Drawing Sheets

AIR ASSISTED SPRAY SYSTEM

FIELD OF THE INVENTION

The present invention relates generally to spray nozzles, and more particularly, to spray nozzles for directing a spray of atomized liquid into the atmosphere in the form of extremely small particles.

BACKGROUND OF THE INVENTION

Spray nozzles for atomizing liquid with a pressurized gas such as air are known in the art. For example, the liquid is sometimes broken up mechanically and by pressurized air in an atomizing chamber located upstream of the spray nozzle. The atomized liquid is then ejected from the nozzle through one or more discharge openings formed at the distal end of the nozzle.

An often-sought goal in atomizing and spraying apparatus is to achieve high efficiency. High efficiency in the context of this invention refers to using as little air energy as possible to break liquid of a given volume into particles having a relatively large total surface area. Larger surface areas are created by breaking the liquid into very fine particles.

A further goal is to provide nozzles having the capability of discharging the liquid in different spray patterns. By way of example, some applications require a narrow angle round spray, other applications may require a wide angle spray such as a full cone spray. Still other applications may require a flat spray.

In prior atomizing/spraying apparatus, the desired spray pattern is usually generated by forcing the atomized liquid through a properly shaped discharge orifice construction disposed in the nozzle. A narrow angle round spray, for example, may be created by providing the nozzle with a single round orifice. A wide angle round spray pattern may be generated by a nozzle having a plurality of angularly spaced diverging orifices. An elongated slot or an elliptically shaped orifice in the discharge nozzle produces a substantially flat spray pattern.

Nozzles having discharge orifices of the above type are essentially passive with respect to effecting further atomization of the liquid as the liquid is discharged from the nozzle. Certain nozzles produce further atomization during flow of the liquid through the nozzle, however, for the most part, the atomization effected by the nozzle has limited impact on the overall efficiency of the atomizing and spraying apparatus. In addition, these nozzles fail to produce a relatively constant spray angle over a varying range of applied air pressures.

OBJECTS AND SUMMARY OF THE INVENTION

The general aim of the present invention is to provide a new and improved spray nozzle assembly which provides enhanced atomization to permit the spraying apparatus to operate with greater efficiency.

Another object of the invention is to provide a spray nozzle assembly with improved stability of a spray pattern of the discharging spray over a range of applied air pressures.

A more particular object of the invention is to achieve the foregoing through the provision of a uniquely designed spray tip which is effective for augmenting particle breakdown for fine particle spraying while maintaining a constant spray angle of the discharging fluid spray.

These and other objects and advantages of the invention will become more apparent from the following detailed description taken in conjunction with the accompanying drawings.

Figure 1:
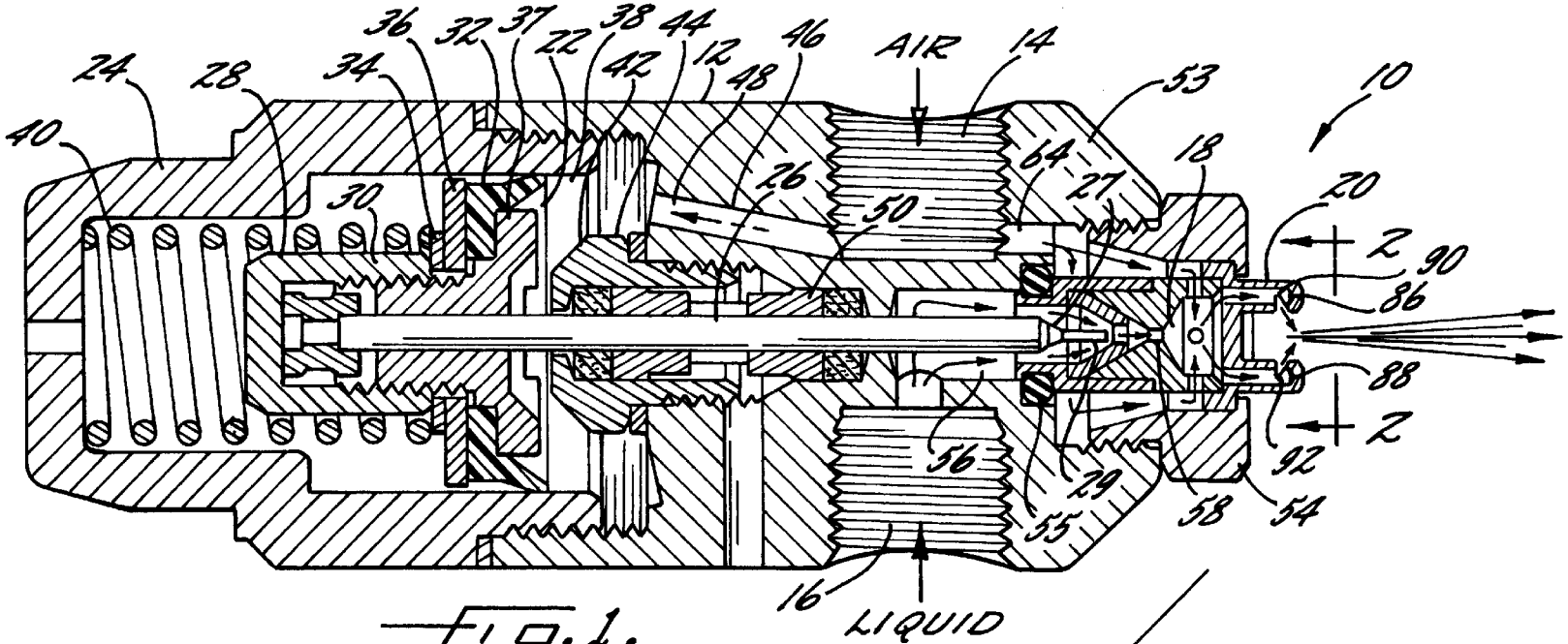
FIG. 1 is a cross-sectional view taken axially through a spray nozzle assembly which incorporates the features of the present invention.

While the invention is susceptible of various modifications and alternative constructions, certain illustrated embodiments thereof have been shown in the drawings and will be described below in detail. It should be understood, however, that there is no intention to limit the invention to the specific form disclosed. To the contrary, the intention is to cover all modifications, alternative constructions and equivalents falling within the spirit and scope of the invention.

DETAILED DESCRIPTION OF THE PREFERRED EMBODIMENTS

Generally, the present invention relates to a spray nozzle assembly that provides improved efficiency in the atomization of a liquid to be sprayed while providing a relatively constant spray angle of the discharging liquid. The invention is intended for use in various applications where an atomized liquid spray is to be impinged on a surface. Typically, the nozzle assembly according to one embodiment may be used for humidification and evaporative cooling. In this embodiment, the invention provides fine droplets at low air and liquid pressures. In another embodiment, the nozzle assembly may be used in spraying viscous and abrasive liquids.

FIG. 1 illustrates a spray nozzle assembly 10 according to one embodiment of the present invention. In this embodiment, an internal air mix atomizer provides atomization of the liquid. The illustrated nozzle assembly 10 comprises a main body 12 formed with threaded liquid and gas inlet ports 14, 16, respectively. The body 12 provides a pre-atomizing section 18 for receiving respective pressurized liquid and gas flow streams for pre-atomizing liquid. A spray tip 20 is mounted downstream of the pre-atomizing section 18 for further breaking down the pre-atomized spray particles and for directing such spray particles in a predetermined spray pattern.

In the illustrated embodiment, the liquid stream is metered into the pre-atomizing section 18 with the use of a metering valve assembly 22. An annular housing end piece 24 disposed opposite the spray tip 20 encloses the valve assembly 22. The end piece 24 is threadably engaged with the main body 12 and has a generally cylindrical inner configuration. An elongate metering needle or stem 26 extends axially through the body 12 and has an end cap 28 disposed at its proximal end. The end cap 28 is threadably engaged with piston or valve head 30. A ring-shaped sealing member 32 surrounds the head member 30 and with an outwardly extending lip thereof forms a seal with the inner periphery of the end piece 24. In combination with a pair of ring members 34 and 36, the valve head 30 retains the sealing member 32 in a fixed position, sandwiched between the ring member 36 and a flange 37 formed in the valve head 30. This construction provides an air chamber 38 within the end piece 24. A biasing spring 40 disposed between the end wall of the housing piece 24 and the valve assembly 22 provides a biasing force to the valve assembly.

The distal end of the metering needle 26 includes a shoulder portion 27 that terminates with a needle tip 29. The needle tip 29 is sized to extend through a metering or flow restricting orifice 58 when moved to a forward position, described in greater detail below.

In the position shown in FIG. 1, the valve assembly 22 is moved rearwardly away from a valve seat 42 provided by an annular lug 44 fixedly attached to the body 12. The lug 44 is provided with a through hole to permit axial movement of the valve needle 26. An air passageway 46 provides communication between the inlet port 14 and the air chamber 38. When pressurized air flows through the air passageway 46 in the direction of the arrow 48, the valve assembly 22 is moved away from the valve seat 44 against the biasing force provided by the spring 40. In this regard, a valve stop 50 is fixedly attached to the valve needle 26 to restrict movement of the clean out/shut off valve 22 beyond a preselected open position.

This construction advantageously permits liquid into the pre-atomizing section 18. For example, the amount of liquid may be closely controlled by applying pulsating air supply to thereby adjust the amount of liquid. Alternatively, the needle may be moved to a desired position to permit a constant flow of liquid pass to the pre-atomizing section 18. The diameter of the needle tip 29 is chosen such that it will pass through the liquid-controlling orifice 58 and clean out any possible obstruction which may clog the orifice 58 when the needle 26 is moved to a forward position. The shoulder 27 insures a positive shut-off of the liquid entering the flow restricting orifice 58.

To facilitate pre-atomization of liquid introduced into the nozzle body 12 from the liquid inlet port 16, the pre-atomizing section 18 further includes a generally cylindrical atomizing member 52 disposed within the body 12 intermediate the gas and liquid ports 14, 16 with the longitudinal axis of the illustrated atomizing member being aligned with the axis of the spray nozzle assembly and in perpendicular relation to an axis though the ports 14, 16. The details of this construction are perhaps best seen with reference to FIG. 4. For supporting the pre-atomizing member 52 within the main body 12, the body 12 has a forwardly extending, internally threaded cylindrical extension 53 into which an externally threaded retainer cap 54 is engaged. The pre-atomizing member 52 has an upstream end supported within a cylindrical chamber 56 of the main body 12 and a downstream end supported within an annular opening formed in the end of the retainer cap 54. An O-ring seal 55 is located proximate to the downstream end of the pre-atomizing member 52 for preventing leakage of the liquid entering the chamber 56. The annular opening of the retainer cap 54 is defined by an inwardly extending annular lip 57 which engages an outwardly extending annular flange 59 of the spray tip 20 for retaining both the spray tip, and the atomizing member 52 in mounted position.

The atomizing member 52 is formed with a central inlet flow passage 56, which communicates with the flow restricting orifice 58, and which in turn communicates with a cylindrical expansion chamber 60 of larger diameter than the flow passageway 56. The flow restricting orifice 58 in this case includes frustro-conical upstream and downstream portions 61, 63, respectively. As seen in FIG. 1, liquid introduced into the port 16 communicates through a body passage 62 and the chamber with the inlet flow passage 56 of the atomizing member 52.

Pressurized air introduced into the air inlet port 14 communicates through a passage 64 in the main body with an annular chamber 66 defined between an outer periphery of a central portion of the atomizing member 52 and a cylindrical wall 67 of an upstream extension of the retainer cap. Pressurized air in the annular chamber 66 is directed into the expansion chamber 60 of the atomizing member 52 through a plurality of radial passages 68. It will be seen, therefore, that pressurized liquid introduced through the liquid port 16 is accelerated through the restricting orifice 58 into the expansion chamber 60 where it is broken up and pre-atomized by a multiplicity of pressurized air streams directed through the radial passages 68. The pre-atomized liquid flow stream is thereupon directed to the spray tip 20 and the atmosphere as a discharging spray pattern.

It will be understood by one skilled in the art that by using an air stream with a selected pressure, greater pre-atomization and liquid particle break down may be achieved. The present invention contemplates utilizing, in one embodiment, relatively low air pressure flow streams, such as about 10–20 psi, for achieving relatively fine liquid particle breakdown. Heretofore, spraying systems using such pre-atomizing air pressures have created relatively sporadic discharging spray patterns that are quite difficult to adequately control.

In accordance with the invention, a nozzle spray tip is provided which contains a fluid passage for conducting the fluid forward into a cavity before deflecting inwardly and exiting through a slotted portion. The slotted portion comprises a deflector surface of a predetermined angle. The nozzle tip uses opposed slotted tips with sprays impinging on themselves. The geometry formed by the cavity in cooperation with the slotted portion permits a spray to be formed which maintains a constant spray angle over a wide range of applied air pressure.

In one disclosed embodiment, the spray tip 20 includes a downstream generally cylindrical chamber 70 communicating with the atmosphere and separated from the atomizing chamber 60 by an end wall 72. The spray tip is formed with a plurality of discharge passages such as opposed passages 74, 76 which extend through the end wall 72 and the spray tip body. The passages 74, 76 which in this case are two in number, are disposed at circumferentially spaced locations near the outer periphery of the spray tip 20. Each of the discharges passages 74, 76 has an upstream open end for receiving pre-atomized liquid exiting the atomizing member 52. In this regard, the downstream end of the expansion chamber 60 is defined by a frustro-conical side wall that generally coincides with the outer walls of the passages 74, 76. The passages 74, 76 communicate with the downstream chamber 70 in a manner that directs the plurality of discharging flow streams and at least in part in a direction toward each other.

Figure 2:
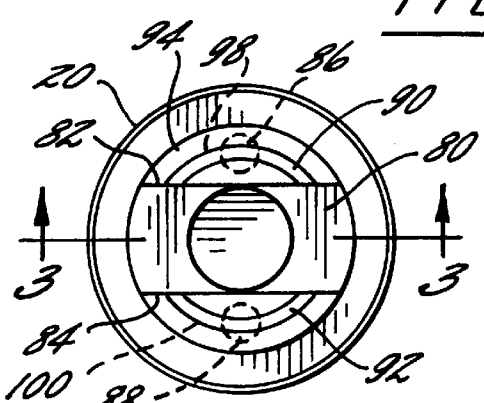
FIG. 2 is an enlarged end view taken through the vertical plane 2—2 shown in FIG. 1.

Each of the passages 74, 76 of the illustrated spray tip 20 has an elongated cylindrical configuration of a diameter substantially less than that of the expansion chamber 60 of the atomizing member 52. The end wall 72 has a substantially flat upstream face which is perpendicular to the axis of the spray tip 20. The spray tip downstream chamber 70 in this instance is defined by a substantially flat downstream face of the end wall 72, which also is perpendicular to the axis of the spray tip. The downstream chamber 70 is further defined by a groove 80 (see FIG. 2) disposed transversely through the spray tip 20 and is arranged at a right angle with respect to the longitudinal central axis. The groove 80 has plane-constructed groove walls 82, 84. The groove walls are arranged lying opposite to one another in spaced paralled relation.

Figure 3:
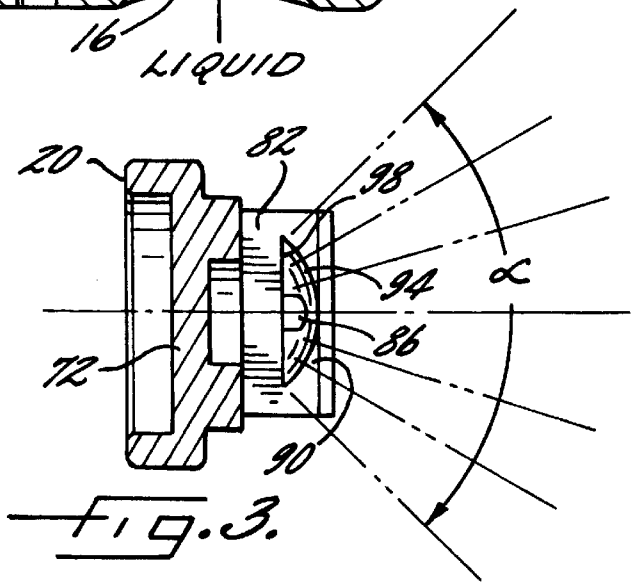
FIG. 3 is a cross-sectional view taken through the horizontal plane 3—3 of the nozzle shown in FIG. 2.
Figure 4:
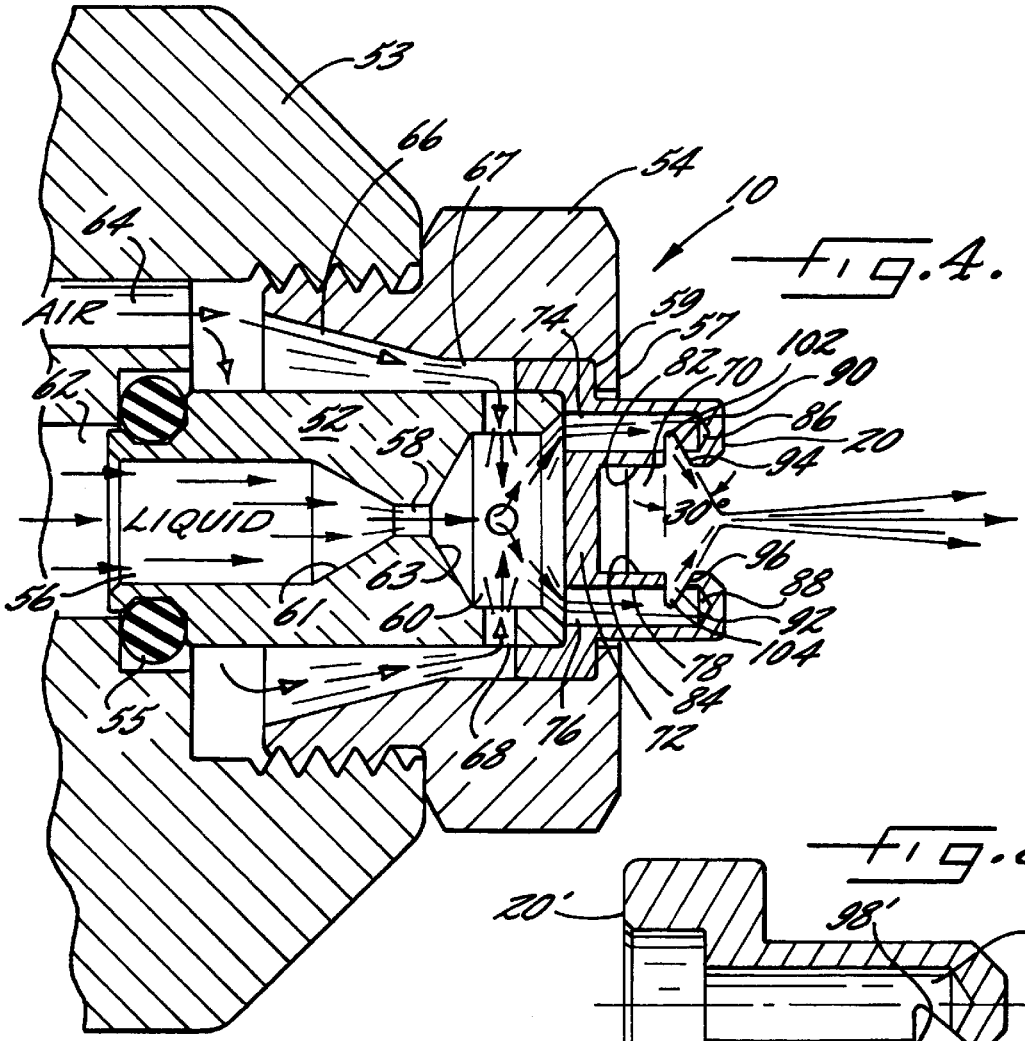
FIG. 4 is an enlarged fragmentary view generally similar to FIG. 1 taken axially through the spray nozzle assembly according to one embodiment of the present invention.

In keeping with the invention, each of the discharge passages terminates with a cavity formed therein such as the cavities 86, 88 shown in FIGS. 1 and 4. In the described embodiment, the cavities are generally conical shaped. Alternatively, they may be cylindrically shaped such that they terminate with a flat surface. Each of the cavities 86, 88 is spaced proximate to and may partially overlap a complementary notched portion such as notched portions 90, 92 formed in the respective side walls 82, 84 defining the chamber 70 and extending through at least a portion of the respective passages 74, 76. These elements cooperatively direct one of the plurality of flow streams into the downstream chamber and at least in part inwardly toward each other. In the illustrated embodiment, the notched portions 90, 92 are angled cuts in the embodiments shown in FIGS. 1–4 and provide opposed slotted openings formed in the downstream chamber walls 82, 84 and partially overlap the passages 74, 76. Each of the notched portions is defined by deflector surfaces 94, 96 that are curved in a portion thereof. The notched portions also include end walls 98, 100 and resemble a crescent or half-moon shaped opening when viewed from the section view of FIG. 3. The notched portions are formed with apex regions 102, 104 disposed in the central portions thereof which overlap the respective passages 74, 76 and taper therefrom on opposed lateral sides.

For providing enhanced breakdown and increased stability to the resulting atomized fluid being passed through the discharge passages, the cavities assist in atomizing the fluid directed toward the respective notched portions. In the illustrated embodiment, the cavities 86, 88 each terminate with a conical end that extends somewhat downstream beyond the notched portion intersection with the respective passage. This feature advantageously creates a "pressure wave" action which deflects fluid rearwardly to provide further atomization of the liquid particles as they exit the discharge opening. In addition, added stability is provided to the discharging stream as it tends to fill the recess provided by the notched portions. The fluid streams are finely atomized flat spray streams that are deflected from the opposed surfaces 94, 96 for directing a portion of the flow stream in a radially inward direction, as depicted in FIGS. 1 and 4. The flat sprays impinge upon each other to produce a resulting spray that is a finely atomized flat spray pattern. As a result of the finer atomization effected by this construction, the efficiency of spray nozzle assembly 10 is increased in that a given volume of liquid may be broken into particles with relatively high surface area even though the air stream is supplied to the assembly at a comparatively low volumetric rate.

In operation, as pre-atomized liquid exits the pre-atomizing member 52 the flow stream will impact the upstream face of the end wall 72 of the spray tip 20, will be diverted in a right angle direction, and will ultimately again be turned in a right angle direction to exit through the discharge passages 74, 76. Such action causes further breakdown and atomization of the liquid as an incident to passage through the spray tip 20. Hence, direct flow of liquid particles through the spray tip 20 is substantially precluded in this embodiment. As the further pre-atomized liquid proceeds through the discharge passages 74, 76, a portion thereof is directed downstream into the respective cavities 86, 88 and is deflected back into other portions thereof and directed radially inwardly into the crescent-shaped groove formed by the contour of the notched portions 90, 92, thereby preventing excessive outward flaring of the discharging liquid particles and causing the spray to have a well-defined pattern, notwithstanding the discharge of relatively fine particles resulting from the pre-atomization. The angle of the discharging spray pattern can thereby be more precisely controlled by the design of the spray tip geometry despite changes in applied air pressure.

Figure 5:
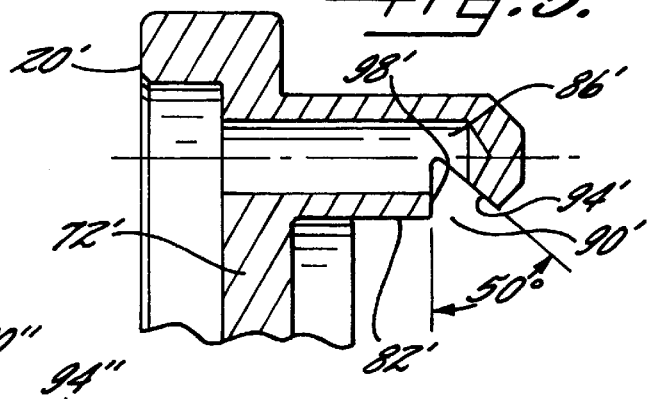
FIG. 5 is an enlarged fragmentary cross-section of a nozzle tip according to a further embodiment of the invention.

In accordance with one important feature, different deflector surface angles or cutter angles may be employed to achieve desired spray angles in the resulting fluid spray. For example, in the embodiment shown in FIGS. 1–4, a cutter angle of approximately 30° is utilized. That is, the angle of the deflector surface 94 with respect to the rear notch end wall 98 is approximately 30°. This will achieve a relatively large resulting spray angle $\alpha$ as shown in FIG. 3. The angle may be varied to provide other spray angles as well. For example, the spray tip 20' illustrated in FIG. 5 is formed with a notched portion 90' that likewise extends partially into a cavity 86' formed in the spray tip. The notched portion 90' provides a deflector surface 94' disposed at an angle of approximately 50° with respect to the notch end wall 98'. This will provide a somewhat smaller resulting spray angle $\alpha$ than the embodiment shown in FIGS. 1–4.

Figure 6:
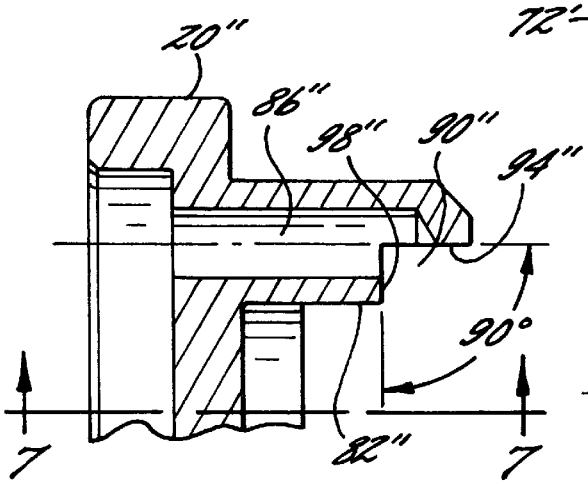
FIG. 6 is also an enlarged fragmentary cross-section of a nozzle tip according to still another embodiment of the present invention.
Figure 7:
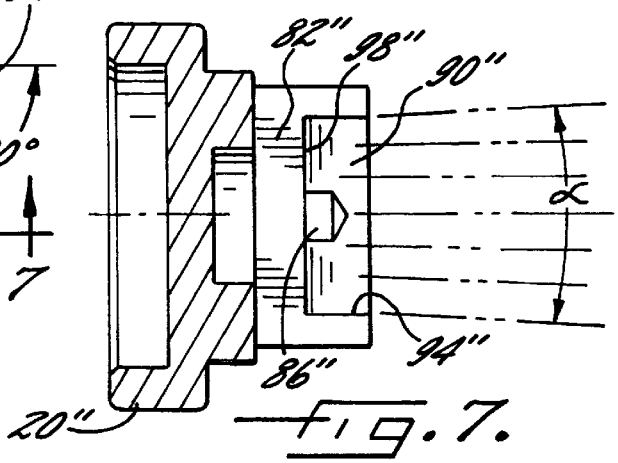
FIG. 7 is a cross-section view of the embodiment of FIG. 6 taken through the horizontal plane 7—7 thereof.

In other embodiments, such as the embodiment shown in FIGS. 6 and 7, a spray tip 20" employs a notched portion 90" defining a cutter angle of approximately 90°. In other words, a deflector surface 94" is positioned at an angle of about 90° with respect to an end wall 98". This will result in a spray angle of about 90°. In this case, the notched portion 90" is formed to extend around the inner periphery of the wall 82" defining the downstream chamber 70".

It has been found that cutter angles from about 30° to 100° may be used in accordance with the invention depending on the desired spray angle of the resulting spray pattern. For example, the spray tip according to the invention may be formed with any desired cutter angle, particularly when fabricated from a metal. Alternatively, the spray tip may be molded of plastic wherein a cutter angle of about 90° or greater may advantageously be implemented by way of example.

Figure 8:
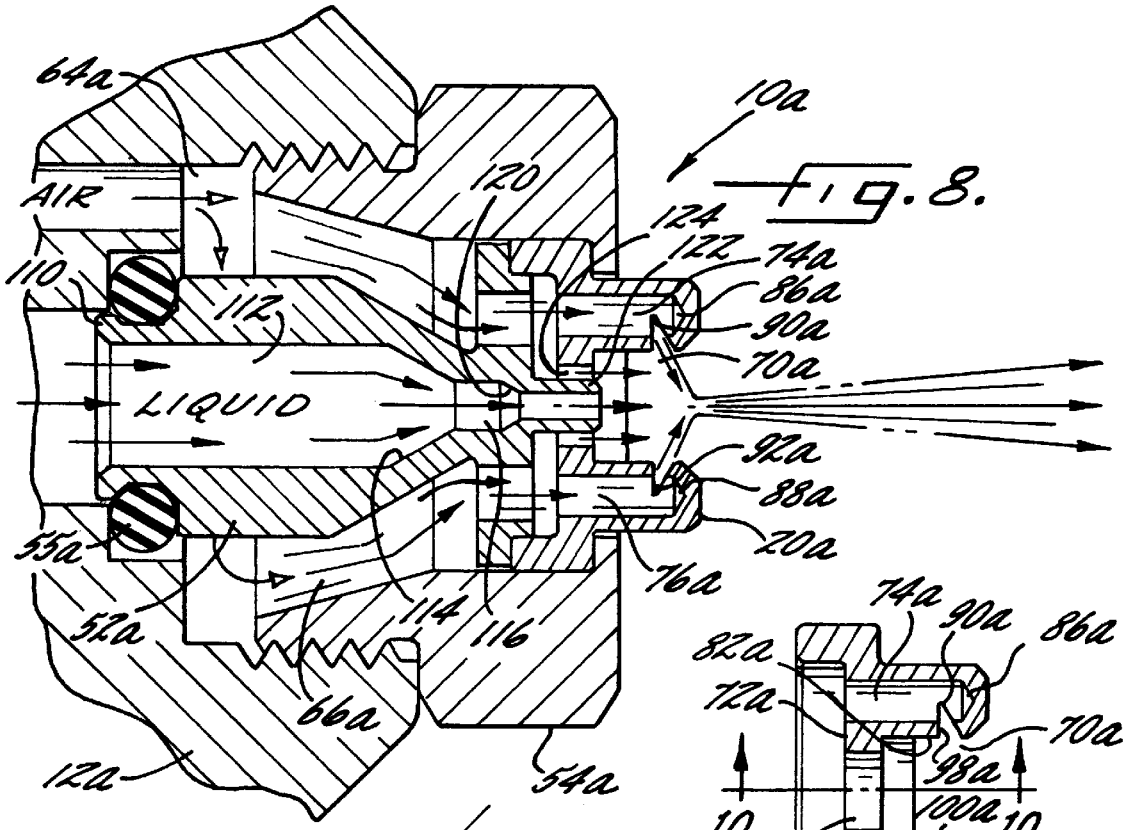
FIG. 8 is a cross-section view taken axially through an external mix air atomizing nozzle assembly according to another embodiment of the present invention.
Figure 9:
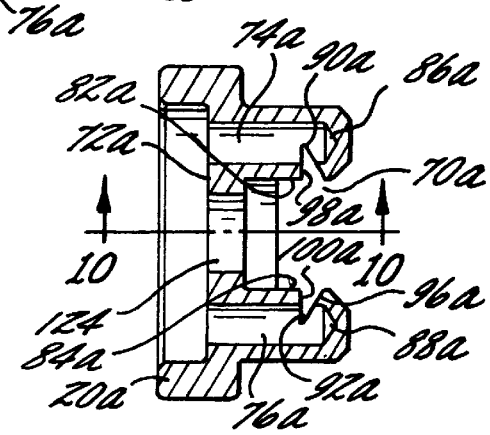
FIG. 9 is an enlarged cross-section view that illustrates the nozzle tip shown in assembly of FIG. 8 in greater detail.
Figure 10:
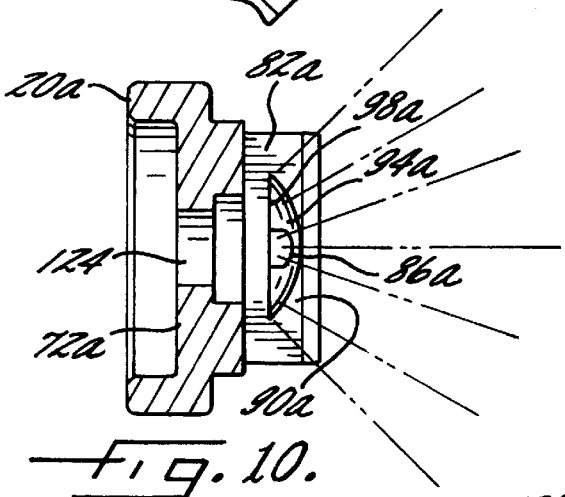
FIG. 10 is cross-section view of the nozzle tip shown in FIG. 9 taken through the horizontal plane 10—10.

Referring now to FIGS. 8–10, there is shown an alternative embodiment of spray nozzle assembly **10*a* in accordance with the invention. Items similar to those described above have been given similar reference numerals with the distinguishing suffix "a" added. The spray nozzle assembly 10*a* has a channel or fluid passage member 52*a* rather than a pre-atomizing member as described above. The member 52***a* provides a longitudinally extending bore concentric to the nozzle body 12*a*. The diameter of the channel generally decreases toward a downstream mixing chamber 70*a* provided in a spray tip 20*a*.

The passage member 52*a* defines various channel sections that direct a liquid stream. A conical entry zone 110 leads to a first cylindrical section 112. A second conical zone 114 couples the first cylindrical section 112 with an intermediate cylindrical section 116. A third conical zone 120 communicates with a metering orifice an exit zone 122 to define a discharge fluid passage. In this embodiment, the spray tip 20*a* is formed with a cylindrical downstream chamber 70*a*. The spray tip 20*a* has an end wall 72*a* which in this case has an opening 124 formed therein to receive the downstream portion of the member 52*a*. In addition, the opening 124 communicates with air passages 66*a*, 68*a* to direct an annular air curtain in surrounding relation with respect to the fluid exiting the metering orifice 122.

Pressurized air introduced through a passage 64*a* in the main body 12*a* is directed through a passage 66*a* defined by the retainer cap 54*a*. The pressurized air is then directed to the discharge passages 74*a*, 76*a*, which as with the embodiment described above, terminate with respective cavities 86*a*, 88*a*. Similarly, notched portions 90*a*, 92*a* are formed in the chamber side walls 82*a*, 84*a* transversely to the discharge passages provide opposed slotted openings. Each of the notched portions 90*a*, 92*a* is defined by deflector surfaces 94*a*, 96*a* that are similarly curved in a portion thereof and by end wall 98*a*, 100*a*. In the embodiment illustrated in FIGS. 8–10, the openings are crescent-shaped or half-moon shaped.

In accordance with another particular feature of the invention, the liquid is discharged into the external chamber in a solid stream. For providing further breakdown of the fluid directed into the downstream chamber, the cavities assist in directing a fan-shaped air stream in an inward direction to impinge the solid liquid stream to thereby produce a finely atomized flat spray that permits the spray to maintain a desired spray angle over a wide range of air pressures. In the illustrative embodiment, fluid directed through the metering orifice 122 is impinged upon by the opposed fan-shaped air streams supplied through the openings 90*a*, 92*a*. In this regard, the cavities 86*a*, 88*a* further assist in stabilizing the air flow streams to provide a constant well-defined pattern. The air streams impinge upon the liquid to form a flat fan spray pattern of atomized fluid with a relatively wide spray angle.

Figure 11:
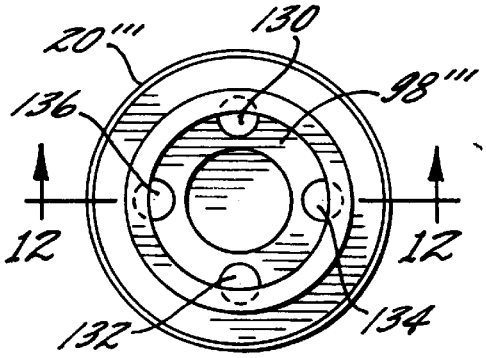
FIG. 11 is an enlarged end view of a nozzle tip of still another embodiment of the invention.
Figure 12:
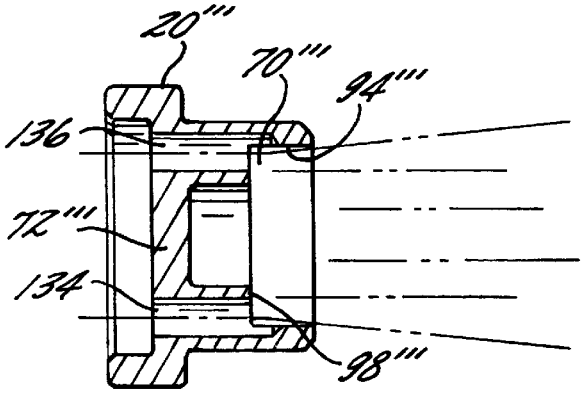
FIG. 12 is a cross-section view of the nozzle tip taken through the horizontal plane 12—12 of FIG. 11.

FIGS. 11 and 12 illustrate a further embodiment of the invention. As shown there, a spray tip 20''' comprises a multiplicity of discharge passages 130, 132, 134, 136 provided at selected spaced locations about the periphery of a downstream or exit chamber 70'''. This embodiment is used in an internal air mix atomizer where the downstream chamber is separated from a pre-atomizing section by an end wall 72'''. In this case, the discharge passages are four in number disposed as pairs of opposed discharge passages. They are disposed to receive pre-atomized liquid from a pre-atomizing section as discussed above in conjunction with FIGS. 1–4. An angled slot in this instance is about 90° and is formed around the inner periphery of the downstream chamber wall, as seen in FIG. 12. This embodiment advantageously provides a generally rounded or oval spray pattern having a relatively narrow angle.

Various advantages in the resulting spray pattern are achieved with the invention. For example, where prior spray nozzles may provide a relatively uneven spray pattern with the tendency for varying resulting spray angles, streaking or the like, the present invention provides a consistent spray pattern over a range of applied air pressures. That is, the resultant spray angle of the atomized liquid maintains its form over a range of pressures. In addition, further breakdown of the liquid particles and resultant higher efficiency is achieved.

Accordingly, a spray nozzle assembly meeting the aforestated objectives has been described. The spray tip according to the invention is adapted for enhancing further break down of the pre-atomized liquid particles and for directing the discharging particles into a well defined spray pattern over a relatively wide range of applied air pressures. To this end, the spray tip provides a unique structural configuration that includes spaced discharge passages each terminating with a cavity formed therein disposed to cooperate with a slotted opening to direct a discharging spray in a predetermined spray pattern. Hence, the spray nozzle assembly is adapted for more efficient atomization.

What is claimed is:

1. A spray nozzle assembly comprising:

an elongate nozzle body having a liquid inlet port and a gas inlet port, a pre-atomizing section within which pressurized streams of liquid and air introduced through said liquid inlet port and gas inlet port are forcefully intermixed to pre-atomize the liquid, and a spray tip downstream of said pre-atomizing section including a downstream chamber, opposed, longitudinally extending discharge passages which communicate between said pre-atomizing section and said downstream chamber, each of said passages terminating with a cavity, and complementary notched portions formed in said spray tip, each of said notched portions defining a deflector surface and cooperating with a corresponding one of said cavities to direct discharging flow stream against said deflector surface for orienting said flow stream at least in part in an inward path toward other flow streams to maintain a relatively constant spray angle over a range of applied air pressures.

2. The invention as in claim 1 wherein each of said notched portions is interposed between said pre-atomizing section and a corresponding one of said cavities.

3. The invention as in claim 2 wherein each of said notched portions is crescent-shaped and defines an apex region that overlaps a corresponding one of said passages.

4. The invention as in claim 3 wherein each of said notched portions substantially coincides with a corresponding one of said cavities.

5. The invention as in claim 3 wherein said deflector surface is formed at an angle of about 30 degrees with respect to an end wall of said notched portion.

6. The invention as in claim 1 wherein said deflector surface is formed at an angle between about 30 degrees to about 100 degrees with respect to an end wall of said notched portion.

7. A spray nozzle assembly comprising:

a nozzle body having a liquid inlet port and a gas inlet port, a first passageway including a metering orifice adjacent an outlet end thereof for transporting the liquid from said liquid inlet port, a second passageway for transporting the gas from the gas inlet port, a pre-atomizing section within which pressurized streams of liquid and air introduced through said first and second passageways are forcefully intermixed to pre-atomize the liquid, and a spray tip disposed at the downstream end of the nozzle assembly, said spray tip having at least one discharge passage formed therein communicating with said pre-atomizing section, the discharge passage including a cavity disposed at a distal end thereof, and a notch formed in the spray tip in overlapping relation with respect to the discharge passage to define a recessed deflector surface, the deflector surface and the cavity cooperatively directing a flow path that produces a defined resulting spray pattern of atomized liquid with a relatively constant spray angle over a range of applied air pressures.

8. A spray nozzle comprising:

an elongate nozzle body having a liquid inlet port and a gas inlet port, a channel communicating with said liquid inlet port including a metering orifice through which a liquid stream is directed, and a spray tip disposed at the downstream end of the nozzle, said spray tip having an atomizing chamber for receiving the liquid stream from said metering orifice, a plurality of air discharge passages formed in an outer peripheral portion of the spray tip each communicating with said gas inlet port, said air passages each including a cavity disposed at a distal end thereof, and a plurality of notches formed in the spray tip in complemental relation with said air passages, said notches each defining a crescent-shaped opening to one of said cavities and a recessed deflector surface, said deflector surfaces and cavities cooperatively directing inward air flow paths that impinge upon the liquid stream in the atomizing chamber to produce a defined resulting spray pattern with a relatively constant spray angle over a range of air pressures.

9. A spray nozzle assembly comprising:

an elongate nozzle body having a liquid inlet port and a gas inlet port, a channel communicating with said liquid inlet port including a metering orifice through which a liquid stream is directed, and a spray tip disposed at the downstream end of the nozzle, said spray tip having an atomizing chamber for receiving the liquid stream from said metering orifice, said spray tip including a centrally disposed annular passageway communicating with the gas inlet port for providing an air curtain in surrounding relation with respect to the liquid stream, a plurality of air discharge passages formed in an outer peripheral portion of the spray tip each communicating with said gas inlet port, said air passages each including a cavity disposed at a distal end thereof, and a plurality of notches formed in the spray tip in complemental relation with said air passages, said notches each defining a recessed deflector surface, said deflector surfaces and cavities cooperatively directing inward air flow paths that impinge upon the liquid stream in the atomizing chamber to produce a defined resulting spray pattern with a relatively constant spray angle over a range of applied air pressures.

10. A spray nozzle assembly comprising:

a nozzle body having a liquid inlet port and a gas inlet port, a first passageway including a metering orifice disposed adjacent an outlet end thereof for transporting liquid from said liquid inlet port, a second passageway for transporting the gas from the gas inlet port, said nozzle body including a pre-atomizing section within which pressurized streams of liquid and air introduced through first and second passageways are forcefully intermixed to pre-atomize the liquid, a spray tip disposed at a downstream end of the nozzle assembly, said spray tip having a downstream chamber separated from said pre-atomizing section by an end wall, said spray tip having at least one discharge passage formed therein communicating pre-atomized liquid between said pre-atomizing section and said downstream chamber, said discharge passage including a cavity disposed at a distal end thereof, and a notch formed in the spray tip in overlapping relation with respect to the discharge passage to define a recessed deflector surface, and said deflector surface and the cavity cooperatively directing a flow path that produced a defined resulting spray pattern of atomized liquid with a relatively constant spray angle over a range of applied air presses.

11. The invention as in claim 10 wherein said notch is crescent-shaped and defines an apex region that substantially coincides with said cavity.

12. The invention as in claim 11 wherein said deflector surface is formed at an angle of about 30 degrees with respect to an end wall of said notch.

13. The invention as in claim 12 wherein said deflector surface is formed at an angle between about 30 degrees to about 100 degrees.

14. A spray nozzle assembly comprising:

a nozzle body having a liquid inlet port and a gas inlet port, a first passageway including a metering orifice for transporting liquid from said liquid inlet port, a second passageway for transporting gas from the gas inlet port, and a spray tip disposed at the downstream end of the nozzle assembly, said spray tip including an atomizing chamber disposed therein for receiving the liquid stream supplied from the metering orifice, said spray tip having at least one discharge passage formed in an outer peripheral portion thereof, said discharge passage including a cavity disposed at a distal end thereof, and a crescent shaped notch formed in the spray tip in overlapping relation with respect to the discharge passage to define a recessed deflector surface, the deflector surface and the cavity cooperatively directing a flow path that produces a defined resulting spray pattern of atomized liquid with a relatively constant spray angle over a range of applied air pressures.

15. A spray nozzle assembly comprising:

a nozzle body having a liquid inlet port and a gas inlet port, a first passageway including a metering orifice disposed adjacent an outlet end for transporting the liquid from said liquid inlet port, a second passageway for transporting the gas from the gas inlet port, a spray tip disposed at the downstream end of the nozzle assembly, said spray tip including an atomizing chamber disposed therein for receiving the liquid stream supplied from the metering orifice, said spray tip having a first discharge passage for directing an air stream into said atomizing chamber substantially parallel to said liquid stream, and said spray tip having at least one second passage for directing said air stream transverse to said liquid stream for atomizing said liquid and directing said atomized liquid in a defined spray pattern.

16. A spray nozzle assembly comprising:

an elongate nozzle body having a liquid inlet port and a gas inlet port, a pre-atomizing section within which pressurized streams of liquid and air introduced through said liquid inlet port and gas inlet port are forcefully intermixed to pre-atomize the liquid, and a spray tip downstream of said pre-atomizing section including a downstream chamber and opposed longitudinally extending discharge passages which communicate between said pre-atomizing section and said downstream chamber, complementary notched portions formed in said spray tip in communicating relation to said longitudinally extending passages, said notched portions defining a deflector surface for directing discharging flow streams at least in part inwardly toward each other to maintain a relatively constant spray angle over a range of applied air pressures.

17. A spray nozzle assembly comprising:

an elongate nozzle body having a liquid inlet port and a gas inlet port, a pre-atomizing section within which pressurized streams of liquid and air introduced through said liquid inlet port and gas inlet port are forcefully intermixed to pre-atomize the liquid, and a spray tip downstream of said pre-atomizing section including a downstream chamber and at least one longitudinally extending discharge passage communicating between said pre-atomizing section and said downstream chamber, at least one complementary notched portion formed in said spray tip in communication with said longitudinally extending chamber defining a deflector surface for directing a discharging flow stream at least in part into said chamber and imparting a predetermined spray angle to said discharging flow stream.

18. The invention as in claim 17 wherein said deflector surfaces each are formed at an angle of about 30 degrees to said longitudinally extending passage.

19. The invention as in claim 17 wherein said deflector surface is formed at an angle between about 30 degrees to about 100 degrees with respect to said longitudinally extending passage.

* * * * *